US007950470B2

(12) United States Patent
Reid

(10) Patent No.: US 7,950,470 B2
(45) Date of Patent: May 31, 2011

(54) MECHANICAL TEE POST DRIVER

(76) Inventor: Jimmy Glenn Reid, Tahlequah, OK (US)

( * ) Notice: Subject to any disclaimer, the term of this patent is extended or adjusted under 35 U.S.C. 154(b) by 0 days.

(21) Appl. No.: 12/562,214

(22) Filed: Sep. 18, 2009

(65) Prior Publication Data

US 2010/0006311 A1 Jan. 14, 2010

Related U.S. Application Data

(62) Division of application No. 11/376,966, filed on Mar. 16, 2006, now Pat. No. 7,597,156.

(51) Int. Cl.
*E21B 7/02* (2006.01)

(52) U.S. Cl. ..... 173/90; 173/91; 173/184; 254/199; 254/129; 254/130; 254/131

(58) Field of Classification Search ..... 173/90, 173/91, 184, 171; 285/121.1, 123.1, 397, 285/398; 175/170; 254/199, 129, 130, 131, 254/227, 230, 237
See application file for complete search history.

(56) References Cited

U.S. PATENT DOCUMENTS

| | | | | |
|---|---|---|---|---|
| 1,533,429 | A * | 4/1925 | Koehn | 294/104 |
| 1,569,857 | A | 1/1926 | Farb | |
| 2,348,820 | A | 5/1944 | Jordan et al. | |
| 2,378,131 | A | 6/1946 | Dirksen et al. | |
| 2,844,006 | A | 7/1958 | Lutz et al. | |
| 2,888,245 | A | 5/1959 | Anderson | |
| 3,934,655 | A | 1/1976 | Whistle | |
| 4,002,210 | A | 1/1977 | White | |
| 4,124,081 | A | 11/1978 | Deike | |
| 4,139,067 | A | 2/1979 | Craig | |
| 4,280,772 | A | 7/1981 | Rusche | |
| 4,542,880 | A | 9/1985 | Bishop | |
| 4,915,180 | A | 4/1990 | Schisler | |
| 4,961,471 | A | 10/1990 | Ovens | |
| 5,167,288 | A | 12/1992 | McNeil et al. | |
| 5,392,866 | A | 2/1995 | White | |
| 5,494,117 | A | 2/1996 | Aldridge | |
| 6,702,037 | B1 | 3/2004 | Thiessen | |
| 6,889,777 | B2 | 5/2005 | Boley et al. | |
| 7,290,754 | B2 * | 11/2007 | Mensi et al. | 254/30 |
| 2006/0113444 | A1 | 6/2006 | Parsons et al. | |

OTHER PUBLICATIONS

Worksaver.com, "Front Loader Mounted Hydraulic Post Driver", , Publisher: worksaver.com.

* cited by examiner

*Primary Examiner* — Rinaldi I. Rada
*Assistant Examiner* — Michelle Lopez
(74) *Attorney, Agent, or Firm* — Fellers, Snider, Blankenship, Bailey & Tippens, P.C.; Terry L. Watt

(57) ABSTRACT

A mechanical fence post driver for attachment to a lift arm of a standard front-loader which includes a mounting plate, guide tube, and roller latch assembly. The guide tube receives a tee or other fence post inserted therein such that it contacts the mounting plate. The fence post is held in place by a roller latch assembly which compresses the post against the rearward side of the guide tube. Insertion of the fence post into the ground is accomplished by lowering the lift arm while the post is held within the guide cylinder. A rotation plate assembly may be positioned between the mounting plate and guide cylinder to provide a convenient mechanism to rotate the guide cylinder in relation to the mounting plate.

17 Claims, 6 Drawing Sheets

MECHANICAL TEE POST DRIVER

RELATED APPLICATION

This application is a divisional of copending U.S. Utility patent application Ser. No. 11/376,966, filed Mar. 16, 2006, the disclosure of which is incorporated by reference as if fully set out at this point.

FIELD OF THE INVENTION

This invention relates to devices for driving tee posts into the ground for the construction of fencing.

BACKGROUND OF THE INVENTION

Tee posts are well known for use in the construction of fencing, such as for retaining livestock and the like. Tee posts support the fencing material (typically wire of some sort) and are typically constructed of metal (steel) and include a series of wire supports along their length. The wire is inserted (strung) into/in/on the wire supports and retained therein. Typically fencing wire is strung on wire supports at multiple heights on the tee post to create a fence.

In the prior art, tee posts are known to be most often driven manually into the ground using a weighted steel cylinder including two opposing handles. The tee post is inserted into the weighted cylinder and the operator grips the handles and repeatedly drives the weighted cylinder against the tee post, thereby driving the tee post into the ground. The obvious drawback of this type of tee post driver is the labor and time involved in lifting and manipulating this weighted device.

In addition to the weighted steel cylinder, specialized machines exist that are used to drive tee posts into the ground. However, they are expensive and large and must be stored when not in use. Additionally, such known devices either require a second operator to manipulate and insert the tee post, or require the operator to repeatedly climb onto and off the device. A need, therefore, exists for a tee post driver which can be attached to a piece of equipment generally available in a setting where fences are constructed which is compact and simple for one individual to operate.

It is an object of the present invention to provide a mechanical tee post driver which can be attached to known mechanized equipment, such as the lift arm of a front end loader. It is a further object of the present invention to provide such a tee post driver which retains the tee post therein for driving into the ground and is compact and simple for one individual to operate. It is still a further object of the present invention to provide a tee post driver which is capable of positioning the wire supports on successive tee posts such that they are oriented in the same direction. Other objects will be hereinafter described and/or become apparent to a person of skill in the art.

SUMMARY OF THE INVENTION

The present invention is a tee post driver for attachment to a lift arm of a standard front-loader. The mechanical tee post driver of the present invention includes, in a first basic embodiment, a mounting plate, rigid linear containment structure (guide tube), and roller latch assembly. The rigid linear containment structure, preferably a guide tube, includes a central cavity at least large enough to accommodate an end of a tee post. The guide tube also includes an upper terminus and a lower terminus. The upper terminus is secured to the mounting plate and the lower terminus includes an orifice for receiving the tee post inserted such that it contacts the mounting plate. Thus, the mounting plate becomes the surface which presses the tee post into the ground while the tee post is retained in the guide tube.

The roller latch assembly is in mechanical communication with the mounting plate and is at least provides a biasing force sufficient to hold the tee post within the guide tube against a force of gravity but insufficient to hold the tee post within the guide tube after the tee post has been at least partially inserted into the ground (earth). The roller latch assembly is preferably mounted to the circumference of guide tube in order to apply a lateral pressure force upon the tee post inserted within the guide tube and retain it therein. The roller latch assembly includes a tension adjuster, tension plate, and a roller latch supported from hinge pins by and between a pair of swing arms. The swing arms each include a rotatable hinge thereon. The swing arms are tied together structurally by the tension plate as well as a pin supporting the roller latch. As a result, the entirety of the roller latch assembly is supported from the hinge pins secured to the guide tube and rotates/pivots as a unit on the swing arms.

The tension adjuster maintains downward/inward pressure on the roller latch thereby securing the tee post in place within the guide tube. The tension adjuster includes a post, a tension nut, and a biasing element tension spring.

As stated, the roller latch assembly applies the resistive force necessary to retain a standard tee post within the guide tube for insertion into the ground. This is accomplished by threading/tightening the tension nut onto the post of the tension adjuster. This compresses the tension spring coiled around the post and applies a force against the tension plate. The downward force applied against the tension plate is transferred through the swing arms, forcing the roller latch against the tee post retained within the guide tube thus retaining the tee post within the guide tube.

Once the tee post is driven into the ground, the lift arm of the front loader is raised leaving the tee post inserted in the ground. This is due in large measure to the fact that the friction of the ground upon the inserted tee post overcomes the force of the roller latch against the tee post. When the lift arm is raised, the tee post is extracted from the guide tube and remains inserted in the ground. The tee post retained in the guide tube is driven into the ground by the force of the lift arm of the front loader, or other suitable means, by either a constant stroke or a series of short hit strokes once the force of retaining the tee post in the guide tube is overcome.

In a second preferred embodiment, a rotation plate assembly may be positioned between the mounting plate and guide cylinder of the present tee post driver. This rotation plate assembly provides a convenient mechanism to rotate the guide cylinder (as well as the roller latch assembly) in relation to the mounting plate, and particularly the lift arm of the front end loader to which it is affixed. This assembly thereby allows successive tee posts to be inserted into the ground such that their respective wire supports are all facing in the same direction without requiring the operator to manipulate each successive tee post by positioning and repositioning the front end loader and/or lift arm.

The foregoing has outlined in broad terms the more important features of the invention disclosed herein so that the detailed description that follows may be more clearly understood, and so that the contribution of the instant inventor to the art may be better appreciated. The instant invention is not to be limited in its application to the details of the construction and to the arrangements of the components set forth in the following description or illustrated in the drawings. Rather, the invention is capable of other embodiments and of being practiced and carried out in various other ways not specifically enumerated herein. Further, the disclosure that follows is intended to apply to all alternatives, modifications and equivalents as may be included within the spirit and scope of the invention as defined by the appended claims. Finally, it should be understood that the phraseology and terminology employed herein are for the purpose of description and should not be regarded as limiting, unless the specification specifically so limits the invention.

While the instant invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE PREFERRED EMBODIMENTS

Figure 1:
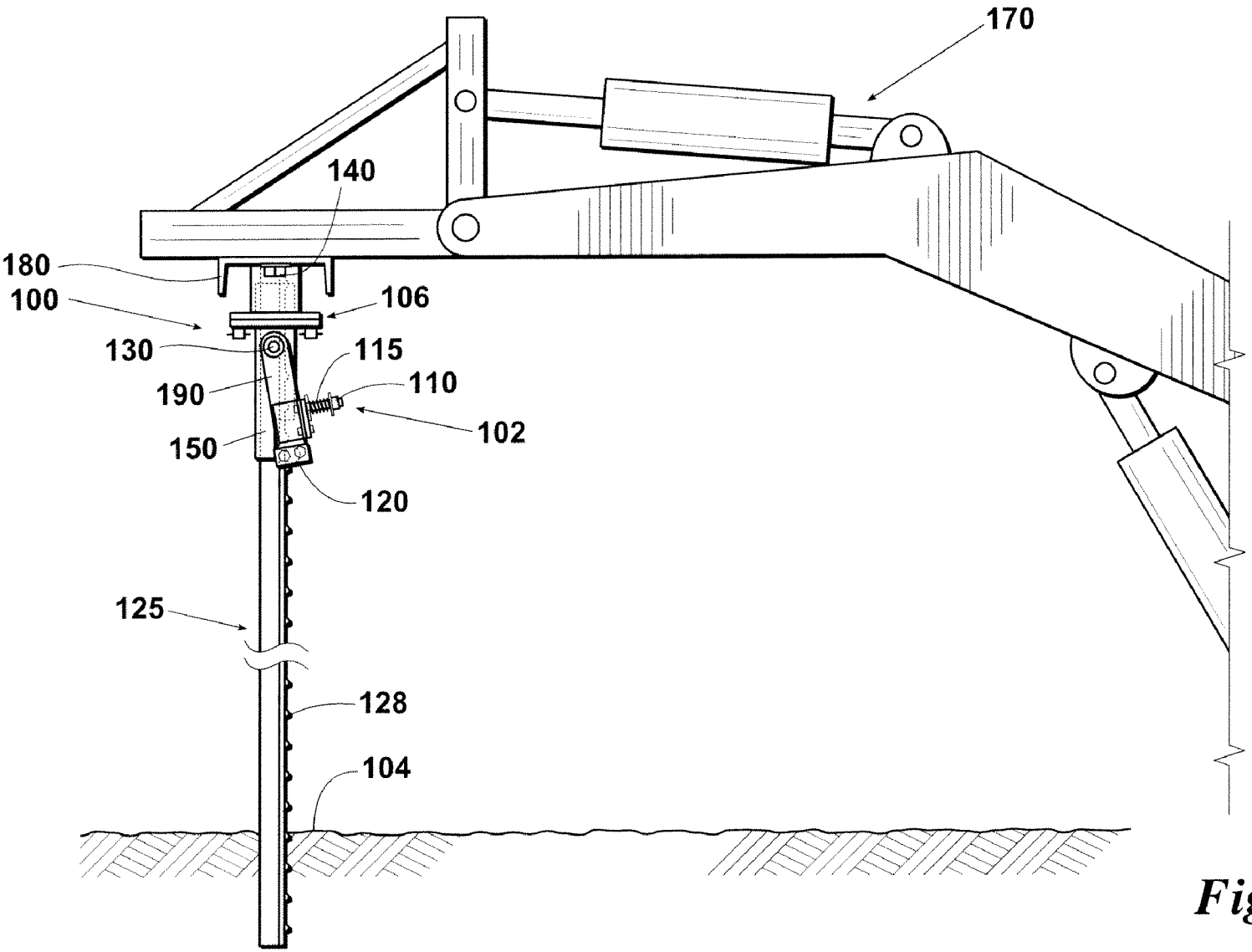
FIG. 1 is a side view of the mechanical tee post driver of the present invention depicted attached to a lift arm of a standard front loader and including an exemplary standard tee post extending therefrom for installation.

Referring now to the drawings, wherein like reference numerals designate corresponding structure throughout the views, and referring in particular to FIG. 1, in this figure a preferred variation of the mechanical tee post driver 100 of the present invention is shown from a side view as being attached to, and extending down from, a schematic depiction of a lift arm 170 of a standard front-loader. It should be understood, however, that although mechanical tee post driver 100 is particularly suited for use and mating to the lift arm of a standard front end loader, tee post driver 100 is not so limited and may be mated to any other piece of construction equipment or other mechanism with some vertical movement range, preferably a range in excess of the length of the post that is being driven into the ground and suitable for driving the post into the ground as described herein. In the alternative, provided that sufficient vertical clearance exists required for the length height of the tee post, a mechanism for providing a linear force to drive the tee post into the ground, such as a hydraulic cylinder, could be inserted between tee post driver 100 and lift arm 170. It should further be understood that although the driver of the present invention is particularly suitable for driving tee posts (also known as T-posts), which are well known in the fencing arts, it is also suitable for driving other types of fence and other posts known in the art and suitable for being driven into the ground, herein collectively referred to as tee post(s).

As can be seen in FIG. 1, an exemplary standard tee post 125, well known in the fencing arts, has been inserted into a guide cylinder 150 of the instant invention in preparation for and being pressed/driven into the ground 104 by vertically lowering the front-loader lift arm 170. The front loader lift arm 170 is not a part of the present invention and operates as is well known in the construction industry.

As is depicted in this FIG. 1, the central goal of the instant invention is to automate the process of driving fence posts, such as tee post 125 illustrated in this figure, into the ground 104.

The mechanical tee post driver 100 of the present invention includes, in a first basic embodiment, a mounting plate 180, guide cylinder 150, and roller latch assembly 102. In a preferred arrangement, roller latch assembly 102 retains a standard tee post, such as 125, within guide cylinder 150 for insertion into ground 104. The roller latch assembly 102 will be described in greater detail below.

In a second preferred embodiment, a rotation plate assembly 106 may be positioned between mounting plate 180 and guide cylinder 150. Rotation plate assembly 106 provides a convenient mechanism to rotate guide cylinder 150 (as well as roller latch assembly 102) in relation to mounting plate 180, and particularly lift arm 170 to which it is affixed. This advantageous assembly thereby allows successive tee posts 125 to be inserted into ground 104 such that their respective wire supports 128 are all facing in the same direction without requiring the operator to manipulate each successive tee post 125 by positioning and repositioning the front end loader and/or lift arm 170.

Figure 2:
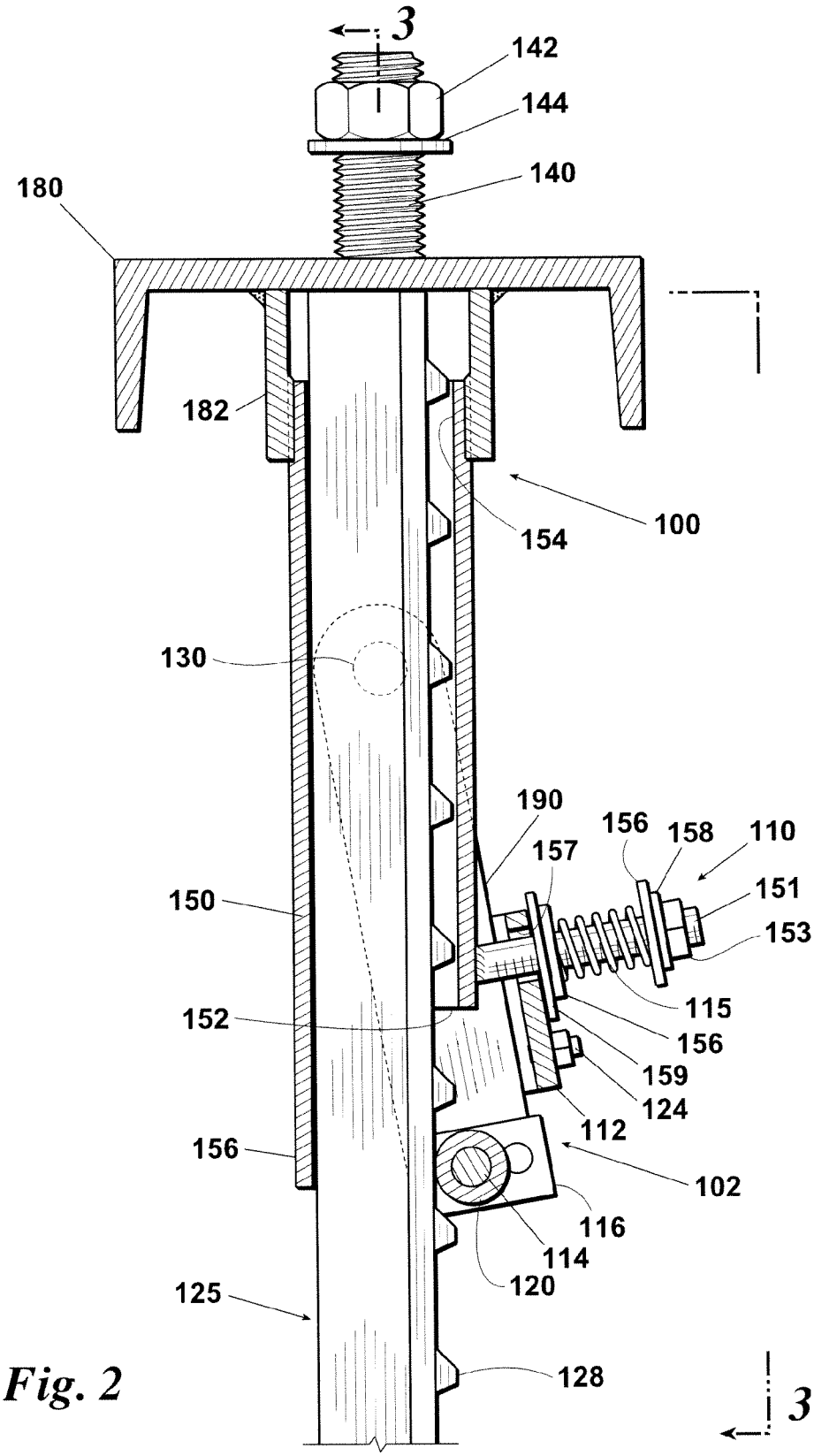
FIG. 2 is a detailed partial cut away side view of the mechanical tee post driver of the present invention depicted with an exemplary standard tee post secured therein.

Turning next to FIG. 2, a detailed partially cut-away side view of the instant mechanical tee post driver 100 may be seen. In the first basic preferred embodiment depicted, the instant invention 100 will be mated, via mounting plate 180, to the underside of a front-loader lift arm (170 as shown in FIG. 1) using mounting bolts 140. It should be understood, however, that mounting plate 180 may be mated to lift arm 170 by any suitable alternative means, such as welding, for example. Mounting plate 180 will preferably be provided with two or more holes for receiving bolts 140 for the purpose of securing tee post driver 100 to the front-loader through suitable holes drilled or provided therein. Nuts, collectively 142, and washers, collectively 144, may be threaded on bolts 140 in order to secure mounting plate 180 to front-loader lift arm (170 of FIG. 1).

A collar 182 may be secured to the underside of mounting plate 180. Collar 182 may be secured to mounting plate 180 in any suitable manner; however, welding is particularly suitable. Collar 182 is generally tubular in shape and dimensioned so as to receive and secure a first end 154 of guide tube 150 which extends and is secured partially within collar 182. In the first basic embodiment, collar 182 secures guide tube 150 to mounting plate 180. First end 154 of guide tube 150 may be secured to collar 182 in any suitable manner known in the art; however, welding guide tube 150 to collar 182 is a particularly suitable method. Collar 182 also allows guide tube 150 to be rotated in the second preferred embodiment described below.

In the preferred embodiments, guide tube 150 is cylindrical in geometry and receives tee post 125 therein. Tee post 125 is inserted into guide tube 150 such that it contacts mounting plate 180. Thus, mounting plate 180 becomes the surface which presses tee post 125 into the ground (104 of FIG. 1)

while tee post 125 is retained in guide tube 150 by pressure against its rearward wall. It should be understood that guide tube 150, and collar 182, could be configured in other suitable alternate geometries and still receive tee post 125 for the purpose of the present invention. That is, although element 150 will be variously referred to as a cylinder or tube herein, it is not essential to the operation of the instant invention that this component be circular in cross section. For example and in the alternative, the guide cylinder 150 might be chosen to be square, triangular, octagonal, etc., in cross section and still function as is suggested herein. In fact, virtually any hollow rigid linear open ended containment structure that is of sufficient strength and has an opening at least large enough to admit entrance of a fence post might be utilized. Those of ordinary skill in the art will recognize how such the shape of the guide cylinder 150 might be adapted to suit the need of a particular situation. Finally, although in the preferred arrangement the guide cylinder 150 will be permanently affixed to the mounting plate 180, that is not absolutely required and it is within the scope of the instant invention that this part be made to be removable (e.g., it could be threaded and screwed into the mounting plate 180).

Figure 3:
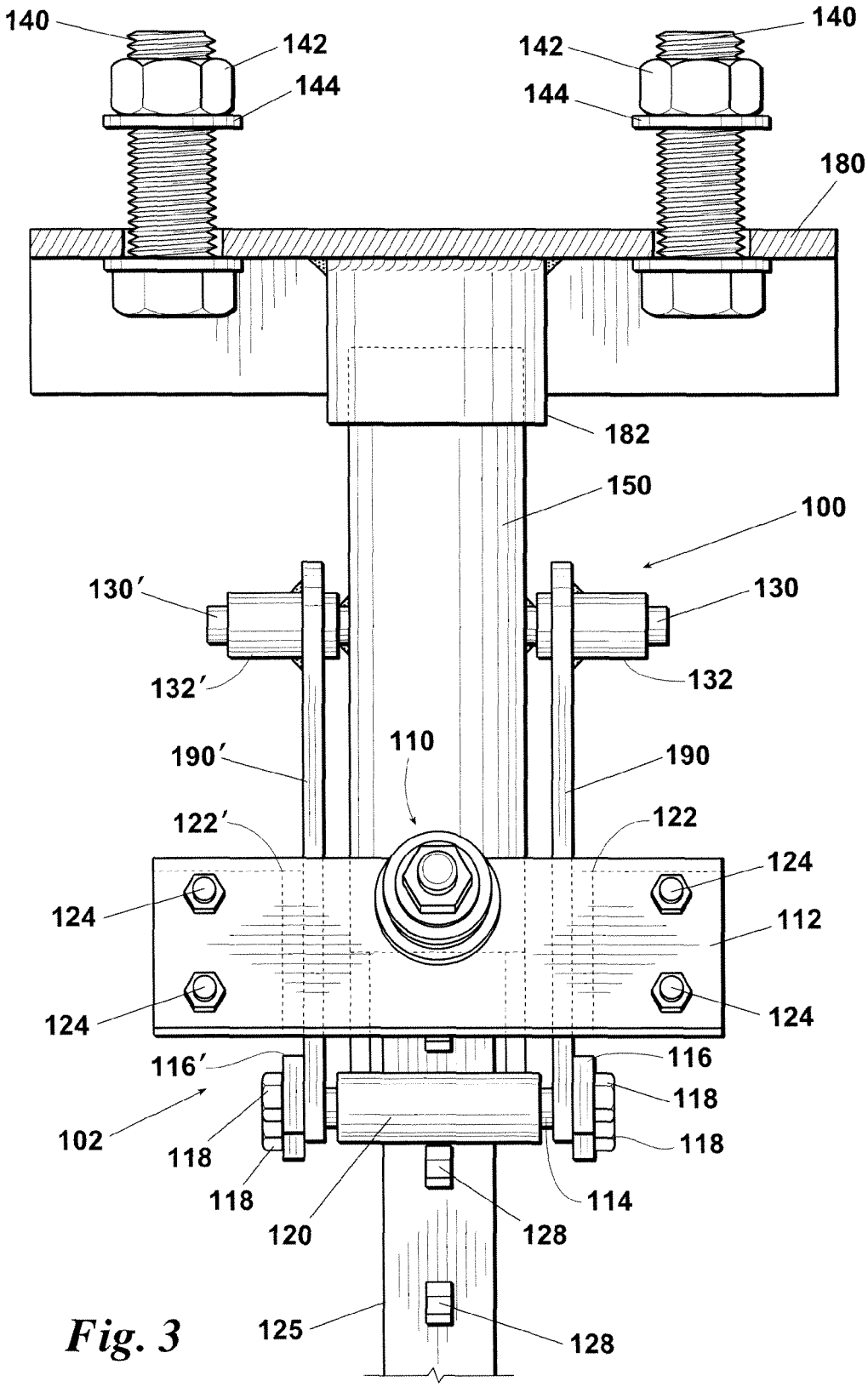
FIG. 3 is a front view of the mechanical tee post driver of the present invention taken along line 3-3 of FIG. 2 with an exemplary standard tee post inserted therein.
Figure 4:
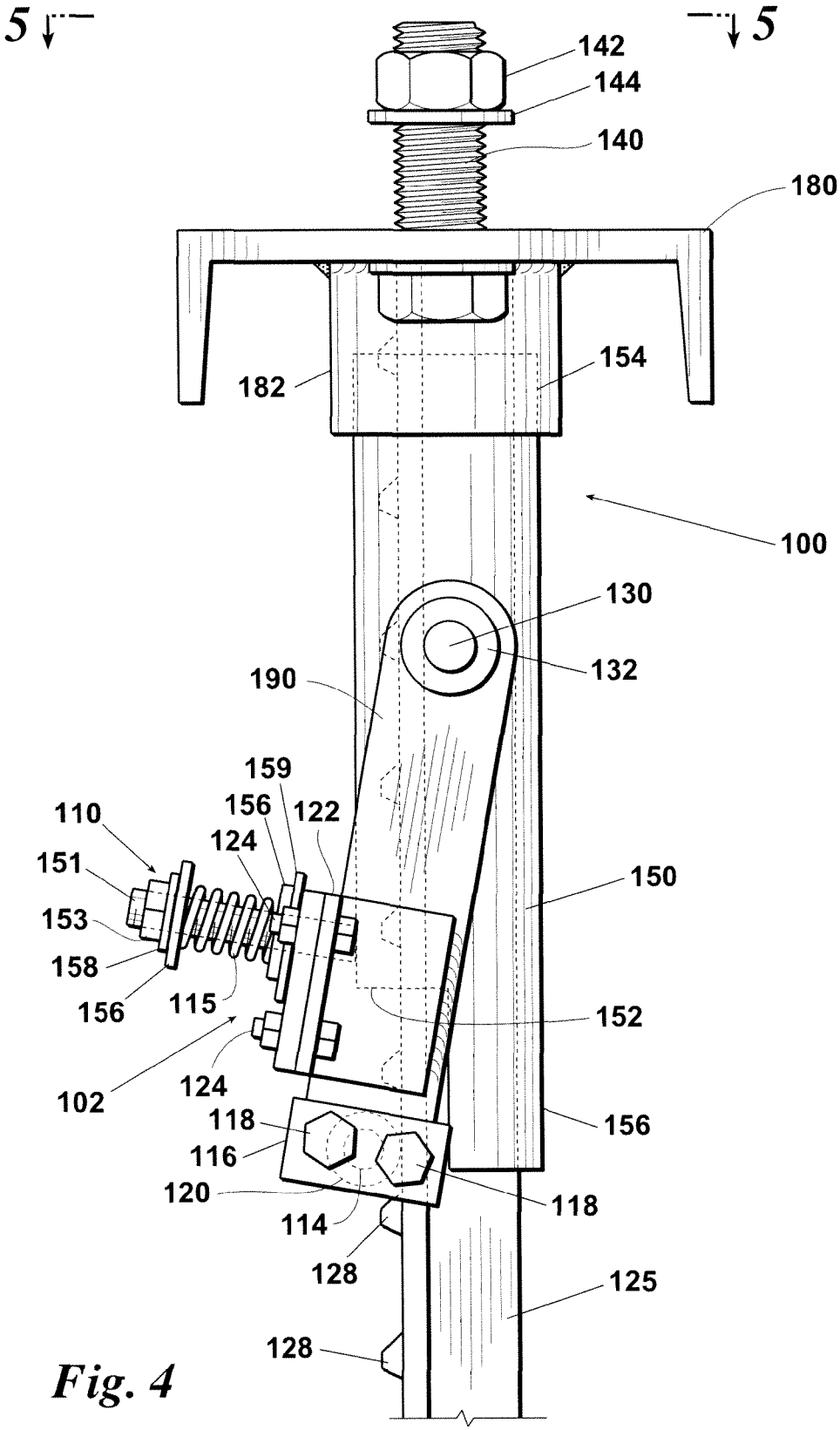
FIG. 4 is an opposite view of FIG. 2 depicting the mechanical tee post driver of the present invention and particularly detailing the roller latch assembly.
Figure 5:
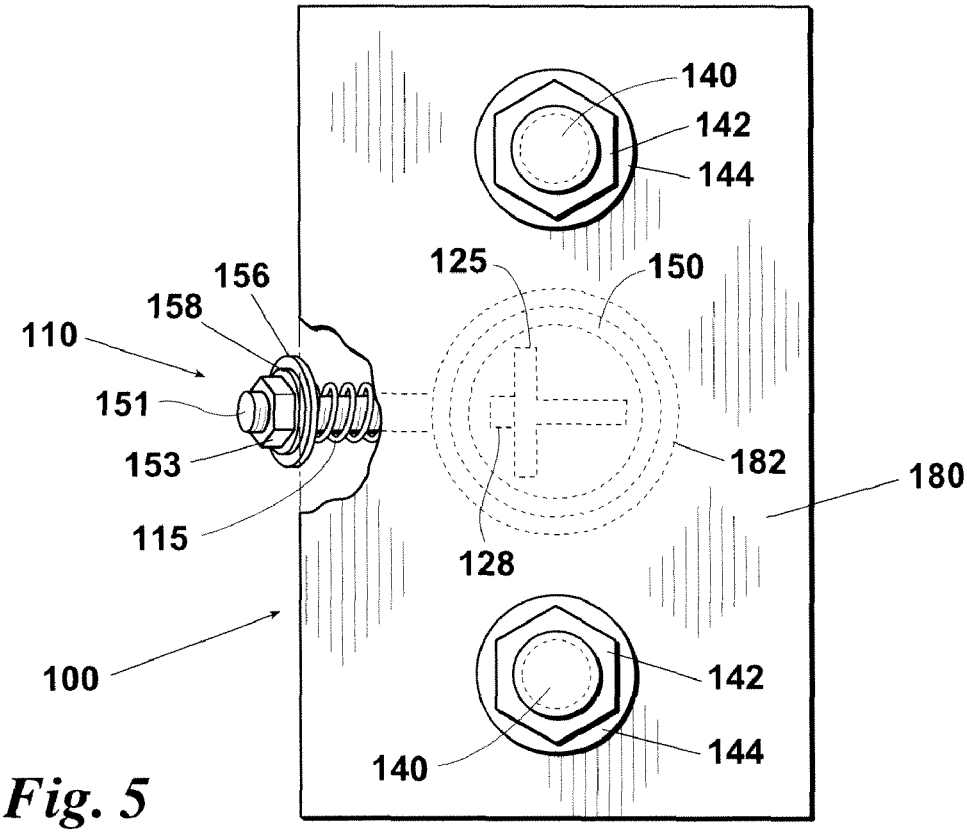
FIG. 5 is a view taken along line 5-5 of FIG. 4 and depicts a partially cut away top view of the mechanical tee post driver of the present invention.

With reference to FIGS. 2 and 3, and in phantom in FIG. 4, it can be seen that second end 156 of guide tube 150 includes a cut out portion 152 in the cylindrical circumference of guide tube 150. Approximately half of the circumference of second end 156 of guide tube 150 is preferably cut out to form cut out portion 152. Of course, the amount of the guide tube 150 that is cut away is not critical to the operation of the instant invention and might vary substantially from the preferred arrangement, for example, it might take the form of a slot or any other configuration that allows the roller latch 120 to contact the inserted fence post. Indeed, it is not even required that the guide tube 150 be cut in the manner suggested by FIGS. 2 and 3 as the roller latch 120 could rest directly on the protruding fence post, although in that configuration it would be preferred that some sort of stops be provided on the exterior of the guide tube 150 to keep the roller latch assembly 102 from moving the roller latch 120 past the guide tube 150 opening when a fence post is not inserted therein.

A roller latch assembly 102 is preferably mounted to the circumference of guide tube 150 in order to apply a lateral pressure force upon tee post 125 inserted within guide tube 150 and retain it therein. Roller latch assembly 102 is preferably mounted to guide tube 150 so as to contact tee post 125 within cut out 152. The purpose of cut out 152 is to provide a resistive surface to oppose the lateral pressure force applied by roller latch assembly 102 at second end 156 of guide tube 150 so as to retain tee post 125 between roller latch assembly 102 and second end 156 (as well as the entire length of guide tube 150). Note that, although the preferred arrangement is to mount the roller latch assembly 102 on the guide tube 150, in other embodiments it might be mounted elsewhere. For example, it might be mounted on guide plate 180.

As stated above, and with reference to FIGS. 2-4, mounted on the side of guide tube 150 will preferably be roller latch assembly 102 which is connected to central guide tube 150 via a pair of hinge pins 130 and 130'. Roller latch assembly 102 preferably includes a tension adjuster 110, tension plate 112, and a roller latch 120 supported from hinge pins 130 and 130' by and between a pair of swing arms 190 and 190'. A pair of rotatable hinges 132 and 132' are secured to swing arms 190 and 190', respectively. Rotatable hinges 132 and 132' are cylindrical in geometry and dimensioned so as to be positioned, and rotate on hinge pins 130 and 130', respectively. Since rotatable hinges 132 and 132' rotate on hinge pins 130 and 130', swing arms 190 and 190', likewise, rotate around hinge pins 130 and 130'. It should be understood that friction reducing means, such as but not limited to lubrication, bearings, or bushings could be employed on roller latch assembly 102, hinge pins 130 and 130', and/or swing arms 190 and 190'.

Roller latch 120 is positioned on a pin 114 such that roller latch 120 rotates freely on pin 114. Pin 114 is of a sufficient length such that it extends through a hole drilled in swing arm 190, through roller latch 120, and terminates in a hole drilled in swing arm 190'. A pair of pin retainer plates 116 and 116' are secured to swing arms 190 and 190', respectively, over the holes drilled therein and retain pin 114 between swing arms 190 and 190'. Thus, roller latch 120 rotates freely on pin 114 but is retained/bounded by and between swing arms 190 and 190'. Note that roller latch 120 is shown for purposes of illustration to be a single roller and, indeed, that is the preferred embodiment. However, multiple rollers could also be used. For example, multiple same-sized rollers might be used in place of the single roller 120. In other preferred arrangements, the multiple rollers might be sized differently. This would be especially useful where, for example, a square post was be driven into the ground via the instant invention. In other embodiments, the rollers might be cone-shaped, such shaping being designed to more closely engage a round fence post.

Retainer plates 116 and 116' are secured to swing arms 190 and 190', respectively, by a plurality of bolts, collectively 118; however, it is understood that retainer plates 116 and 116' may be secured to swing arms 190 and 190' by any suitable means, such as welding and the like. Bolts 118 are particularly suitable so as to allow pin 114 and roller latch 120 to be removed for maintenance or replacement as necessary. In addition, bolts 118 allow removal of roller latch 120 for replacement/interchange with a roller latch which accommodates other shapes of tee posts.

Tension plate 112 is secured to, and extends between, swing arms 190 and 190'. Tension plate 112 structurally unifies roller latch assembly 102 and provides the structure against which tension adjuster 110 supplies the resistive pressure in order for roller latch 120 to retain tee post 125 within guide tube 150. A pair of L-shaped brackets 122 and 122' (shown in phantom in FIG. 3) are secured to swing arms 190 and 190', respectively. L-shaped brackets 122 and 122' may be secured to swing arms 190 and 190' in any suitable manner known in the art, however, welding L-shaped bracket 122 to swing arm 190 and L-shaped bracket 122' to L-shaped bracket 190' is particularly suitable for the present application. A plurality of bolts, collectively 124, may be used to secure tension plate 112 to L-shaped brackets 122 and 122' such that tension plate 112 extends between swing arms 190 and 190'.

In the assembly of roller latch assembly 102 as described herein, it will be recognized that swing arms 190 and 190' are tied together structurally by tension plate 112 as well as pin 114 (supporting roller latch 120). As a result, the entirety of roller latch assembly 102 is supported from hinge pins 130 and 132 secured to guide tube 150 and rotates/pivots as a unit there from on swing arms 190 and 190'.

Attention shall next be directed to tension adjuster 110 depicted in FIGS. 2-4. Tension adjuster 110 includes post 151, tension nut 154, and tension spring 115 bounded between a pair of tension washers, collectively 156.

Post 151 is secured to the exterior circumference of guide tube 150 adjacent first end 156 and preferably just above cut out 152. Post 151 may be secured to guide tube 150 in any suitable manner known in the art. In the preferred embodiment, post 151 is welded to the exterior circumference of guide tube 150 approximately half way between swing arms 190 and 190'.

Post 151 extends from guide tube 150 through a hole 157 drilled in tension plate 112. In the preferred embodiments, hole 157 is oblong in shape in order to allow tension adjuster 110 (and particularly post 151) to remain properly oriented. Post 151 is preferably secured to guide tube 150 such that it extends/points in a slightly upward direction thereby being oriented approximately perpendicular to tension plate 112 as it extends there through.

Tension spring 115 is positioned on post 151 between tension plate 112 and tension nut 154 and is bounded by tension washers 156. Post 151 is threaded to receive tension nut 154. Additional washers, such as washer 158 may be inserted between tension washer 156 and tension nut 154 or washer 159 positioned between tension washer 156 and tension plate 112. As used herein, the term tension spring may include the coil spring 115 depicted in the figures, or may include other known assemblies such as flat springs, leaf springs, elastomers, (electro)magnets, or even hydraulic or pneumatic devices.

As stated above, roller latch assembly 102 applies the resistive force necessary to retain tee post 125 within guide tube 150 of the inventive device 100. This function is best seen in FIGS. 3 and 4, which depict the basic first embodiment of the instant invention with a small section of a tee post 125 depicted inserted therein.

This is accomplished by threading/tightening tension nut 154 onto post 151. This compresses tension spring 115 and applies a force against tension washer 156 and tension plate 112. The downward force applied against tension plate 112 is transferred through swing arms 190 and 190' forcing roller latch 120 against tee post 125 within guide tube 150. Tension adjustor 110 is designed to keep downward pressure on the roller latch 120, thereby tending to secure post 125 in place within guide tube 150 of tee post driver 100.

In operation, lift arm (170 of FIG. 1) of the front-end loader would be raised or otherwise adjusted until the instant invention 100 is tilted away at least slightly from the vertical, thereby making it easier for a tee post 125 to be inserted therein. Next, the wire supports 128 will preferably be turned away from the roller latch 120 and the tee post 125 will be inserted into the instant invention 100. Next, the tee post will be rotated so that the wire supports 128 face the roller latch 120, thereby securing the tee post 125 within the instant device 100 while it is readied for insertion into the ground 104. Next, the front-loader operator will level the section of the front-loader arm that contains the instant invention 100 and begin to apply pressure downward, which might come in the form of continuous pressure or a series of short strokes. Downward pressure will be continued until the desired depth within the ground 104 is reached, at which time the operator will raise the front loader lift arm 170 leaving the post 125 in the ground 104. Note that the method by which tee post 125 is secured within the instant invention 100 (i.e., by tension as applied by roller latch assembly 102) makes it possible to raise the front-loader lift arm 170 without disturbing the post 125 that was just set into the ground 104.

Figure 6:
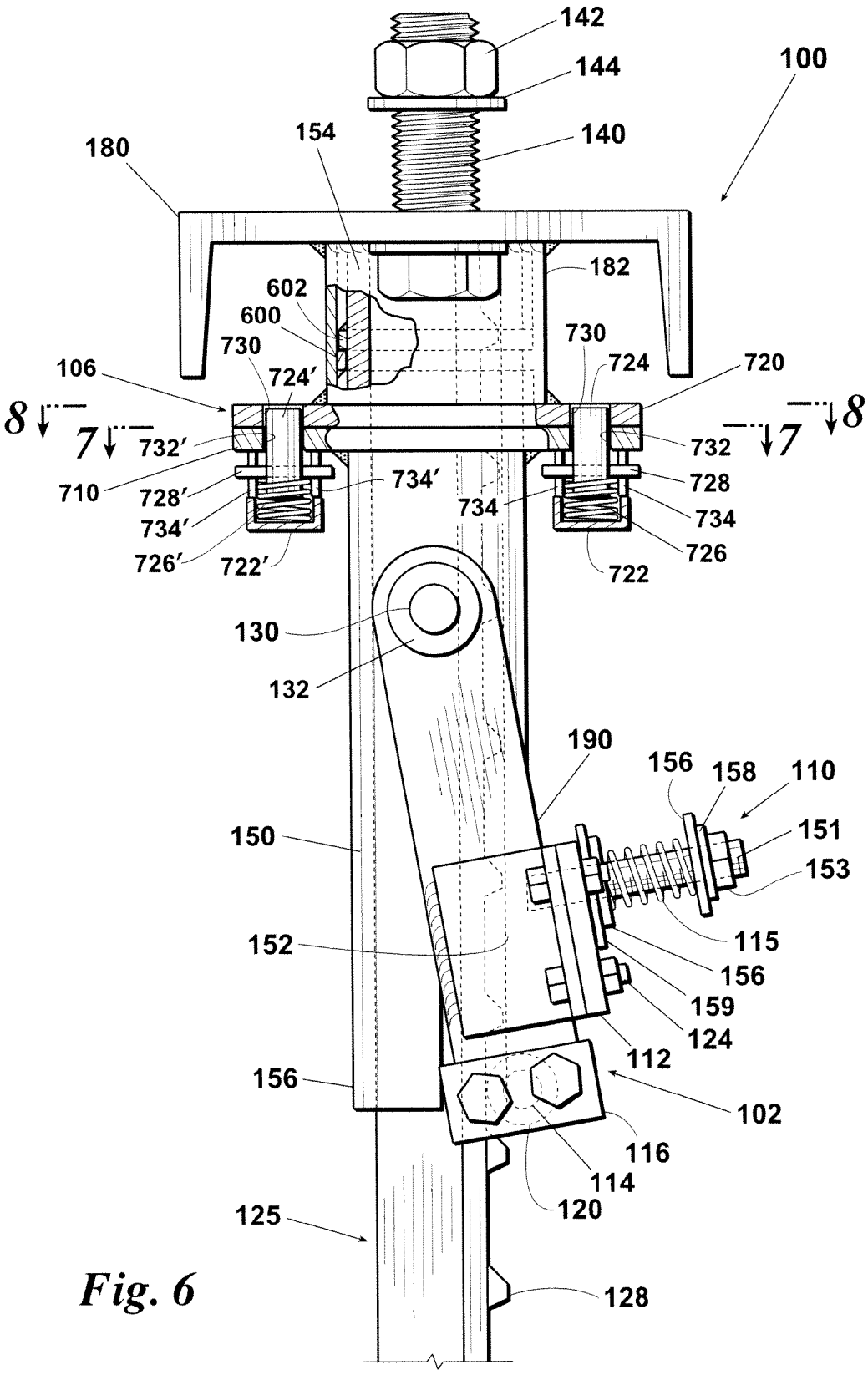
FIG. 6 is a side view of an alternate preferred embodiment of the tee post driver of the present invention depicting a partial cut away view of the rotation plate assembly.

In most applications, it is desirable to have the wire supports 128 all facing the same direction on every tee post 125. In view of that, and as is generally indicated in FIG. 6, a second preferred embodiment is depicted including a system for rotating the captive tee post 125 after it has been inserted into guide tube 150 of the device 100. In this embodiment, guide tube 150 is not secured to collar 182 and instead a rotation plate assembly 106 is inserted so as to allow guide tube 150 to rotate in relation to collar 182.

Rotation plate assembly 106 includes an upper stationary plate 720, a lower rotating plate 710 and pins 724 and 724'. Upper stationary plate 720 is secured, preferably by welding, to collar 182. Since collar 182 is secured to mounting plate 180 and mounting plate 180 is secured to the lift arm of the front end loader, upper stationary plate 720 secured to collar 182 is stationary in that it does not rotate with respect to collar 182 or mounting plate 180.

In order to obtain the ability to rotate guide tube 150 and tee post 125 secured therein with respect to collar 182 and mounting plate 180, a lower rotating plate 710 is secured, preferably by welding, to the circumference of guide tube 150 adjacent first end 154. Lower rotating plate 710 is capable of rotation with respect to upper stationary plate 720 and may be secured in a selected rotational position by pins 724 and 724'.

In order to retain first end 154 of guide tube 150 within collar 182, a retainer ring 602 is secured, preferably by welding, to the outer circumference of first end 154 of guide tube 150. A support ring 600 is secured, preferably by welding, to the interior circumference of guide tube 182. As depicted in FIG. 6, retainer ring 602 rests upon and is supported by support ring 600 with guide tube 150 thereby retained and supported within collar 182 such that first end 154 preferably abuts mounting plate 180.

Figure 7:
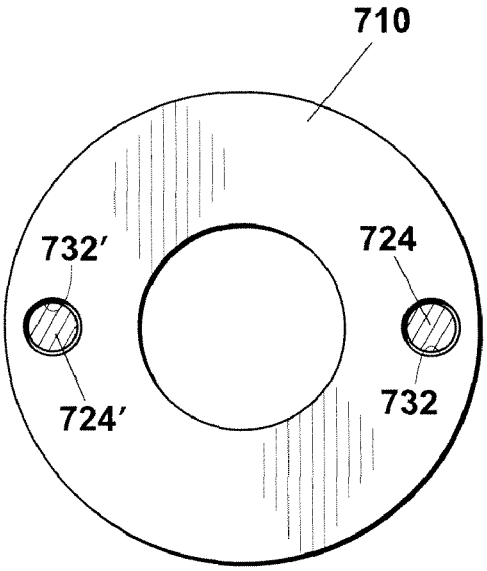
FIG. 7 is a view of the bottom rotating plate taken along line 7-7 of FIG. 6.
Figure 8:
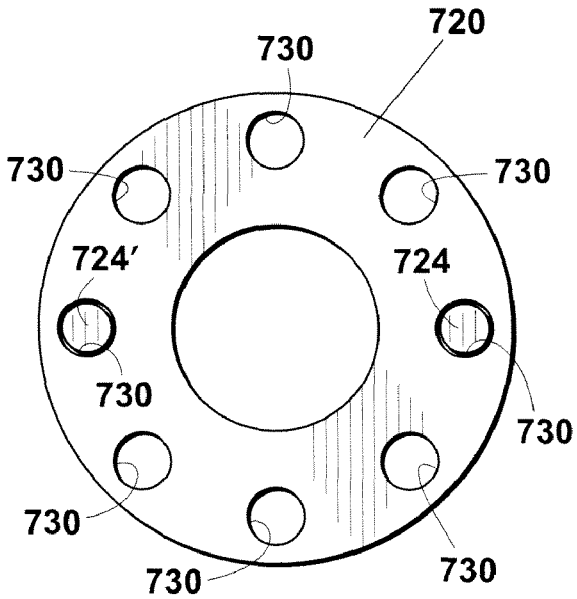
FIG. 8 depicts the top stationary plate taken along line 8-8 of FIG. 6.

As shown in FIG. 6 taken in combination with FIGS. 7 and 8, in the second preferred arrangement, upper stationary plate 720 (FIG. 8) will have a number of stop positions, collectively 730, therein which are matched to holes 732 and 732' in lower rotating plate 710 (FIG. 7). The number of stop positions placed in lower rotating plate 710 will affect the ability to rotationally position guide tube 150, and tee post 125 retained therein. Pins 724 and 724' extend through holes 732 and 732', respectively, and into respective, selected stop positions 730 to secure lower rotating plate 710 to upper stationary plate 720 and prevent it from rotation. Thus, the guide tube 150 and its captive tee post 125 can both be rotated to at least approximately face the fence supports 128 in any particular direction without moving the front-loader. Additionally, in other preferred embodiments, the positions of the upper and lower plates can be reversed so that pins 724 and 724' can be installed in either an "up" or "down" orientation.

Pins 724 and 724' may be retracted from stop positions 730 so that lower rotating plate 710, and thereby guide tube 150 may be rotated and then pins 724 and 724' repositioned in alternate respective stop positions 730. Pin housings 722 and 722' are secured to the lower surface of lower rotating plate 710. Pins 724 and 724' extend upwardly from pin housings 722 and 722', respectively, through holes 732 and 732', respectively, in lower rotating plate 710 and into selected stops 730 in upper stationary plate 720. A biasing force is applied to maintain pins 724 and 724' within stops 730 as described by springs 726 and 726'. In the preferred embodiment, springs 726 and 726' are coil springs, however, other types of springs or biasing members are known in the art and may be substituted. Springs 726 and 726' are retained within pin housings 722 and 722', respectively. Pins 724 and 724' may extend inside the coils of springs 726 and 726'.

Pins 724 and 724' each include a respective cross post 728 and 728'. In the preferred embodiment, cross posts 728 and 728' extend transversely through pins 724 and 724', respectively and extend beyond a pair of slots 734 and 734' machined on each side of pin housings 722 and 722'. Slots 734 and 734' may be dimensioned and shaped in any appropriate manner. Cross posts 728 and 728' rest upon springs 726 and 726' within pin housings 722 and 722' such that cross posts 728 and 728' may be pulled downward, away from lower rotating plate 710 thereby compressing springs 726 and 726' and retracting pins 724 and 724' from stops 730 in upper stationary plate 720. Lower rotating plate 710 (as well as guide tube 150) are then free to rotate with respect to upper stationary plate 720 (as well as collar 182 and mounting plate 180). Once the desired rotational location is obtained, cross posts 728 and 728' may be released such that springs 726 and 726' force their respective pins 724 and 724' into the closest set of stops 730 in upper stationary plate 720 in order to secure that desired rotational position of lower rotating plate 710 with respect to upper stationary plate 720. The desired rotational position of wire supports 128 of tee post 125 may thus be obtained. Those of ordinary skill in the art will recognize that although the preferred embodiment of the instant invention calls for manual insertion and removal of the locking pins 724 and 724', alternatively those pins might be operated mechanically using, by way of example only, hydraulic, magnetic, or pneumatic means.

Note that although in the preferred embodiment the roller latch 120 takes the form of a rotating cylinder, that structure is not really strictly required. The primary function of the roller latch 120 is to removably secure a fence post within the guide cylinder 150 and hold it in place while the lift arm is 170 is being moved into position. Those of ordinary skill in the art will recognize that this broad function might be served by many different component configurations. All that is required is that roller latch 120 provide sufficient compressive force to hold the post in place against gravity and then automatically disengage from and/or release the post after it has been inserted into the ground. It might be any arbitrary geometrical shape in cross section so long as it satisfies the previous simple requirement. As a first example of some alternative structures, the roller 120 might be a partial (e.g., half) cylinder that is oriented with its rounded face toward the fence post and that does not rotate but instead slides along/bumps over the post wire supports 128, i.e., it is not essential that the latch roller 120 actually rotate nor need it be round in cross section, although that is preferred. As another example, it might be octagonal, square, triangular, etc., although in the event that the roller 120 is chosen to be, say, square in cross section, it would be better if that element rotatable upon insertion and removal of the fence post.

Finally, those of ordinary skill in the art will further recognize that although in the preferred embodiment a single coil spring 115 is configured to operate against the tension plate 112, that arrangement is not strictly necessary. In other preferred arrangements, one or more biasing elements (preferably coil springs) will be directly attached at one end to the exterior of the guide cylinder 150 and attached at the other end to either the arm 190 or some other component that is in mechanical communication with the latch roller 120. Obviously, the biasing element might be a metal coil spring or any other structure or material with resilient elastic properties (e.g., rubber, plastic springs, hydraulics, electromagnets, etc.)

Thus, the instant invention provides a means and apparatus that makes it possible for a fence post to be positioned, leveled, driven, and released by the operator while he or she remains at the controls of the equipment. Those of ordinary skill in the art will recognize the instant invention greatly simplifies and accelerates the process of driving fence posts and especially so if that individual is working alone.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. A post driver suitable for attachment to a lift arm of a mechanized device, wherein said lift arm may be at least raised and lowered by said mechanized device under operator control, thereby driving a fence post into the ground when the fence post is within said post driver during its lowering, said post driver comprising:

(a) a mounting plate, said mounting plate at least for attachment to an under side of the lift arm;

(b) a rigid linear containment structure having a central cavity at least large enough to accommodate an end of the fence post therein, said containment structure having an upper terminus and a lower terminus, said upper terminus of said containment structure being secured to said mounting plate and said lower terminus having an orifice therein, said orifice (i) providing access to said central cavity of said containment structure, and, (ii) being sized at least large enough to receive the end of the fence post into said central cavity;

(c) a roller latch assembly in mechanical communication with said mounting plate, said roller latch at least for providing a resilient biasing force urging said roller against the fence post when the fence post is positioned within said central cavity, wherein (i) said biasing force is opposed by an inner wall of said containment structure, and (ii) said biasing force is sufficient to hold the fence post above the ground within said containment structure against a vertical force of gravity but insufficient to hold the fence post within the containment structure when the containment structure is lifted off of the fence post after the fence post has been at least partially inserted into the ground.

2. A post driver according to claim 1, wherein said containment structure is at least approximately circular in cross section.

3. A post driver according to claim 1, wherein said roller latch assembly is mounted directly on an exterior of said containment structure.

4. A post driver according to claim 3, wherein said roller latch assembly comprises:

(c1) a first and a second swing arm, each of said swing arms being rotatably mounted to an opposite side of said containment structure, (c2) a tension plate connecting said first and second swing arms, said tension plate having at least one aperture therethrough, (c3) a biasing post having a first end and a second end, wherein said first end of said biasing post is affixed to said containment structure, and wherein said second end of said biasing post is positionable to pass through said aperture in said tension plate, (c4) a roller latch supported by said first and second swing arms, said roller latch being positionable to contact the fence post when it is present within said containment structure, and, (c5) a biasing element situated proximate to said second end of said biasing post and in mechanical communication therewith, said biasing element providing a biasing force against said tension plate and said roller latch and toward said containment structure, said roller latch being forced against the fence post when it is present within said containment structure, wherein (i) said biasing force is opposed by an inner wall of said containment structure, and (ii) said biasing force is sufficient to hold the fence post within said containment structure against a force of gravity but insufficient to hold the fence post within the containment structure after the post has been at least partially inserted within the earth.

5. A post driver according to claim 4, wherein said biasing element is a coil spring.

6. A post driver according to claim 4, wherein said roller latch is circular in cross section.

7. A post driver according to claim 1, wherein the fence post is a tee post.

8. A post driver according to claim 1, wherein said rigid linear containment structure comprises:

(b1) a tubular collar, said tubular collar having a first end and a second end, said first end of said collar being affixed to said mounting plate, and, (b2) a guide cylinder, said guide cylinder having a upper terminus and a lower terminus, said upper terminus being sized to fit within said second end of said tubular collar and being secured thereto, said guide cylinder having a central cavity at least large enough to accommodate an end of the fence post therein, said lower terminus having an orifice therein, said orifice being sized at least large enough to receive the end of the fence post therein.

9. A post driver according to claim 8, wherein said lower terminus of said guide cylinder has a cut out portion therein, wherein said cut out portion is at least to provide access by said roller latch assembly to the fence post, said roller latch assembly biasing the fence post against a reward portion of said guide cylinder cut out portion when the fence post is positioned therein.

10. A post driver according to claim 1, wherein said containment structure is rotatable with respect to said mounting plate while the fence post is contained therein.

11. A post driver according to claim 1, wherein said containment structure comprises:

(b1) a tubular collar, said tubular collar having a first end and a second end, said first end of said collar being affixed to said mounting plate, and, (b1) a guide cylinder, said guide cylinder having an upper terminus and a lower terminus, said upper terminus being sized to fit within said second end of said tubular collar and being rotatably secured therein, said guide cylinder having a central cavity at least large enough to accommodate an end of the fence post therein, said lower terminus having an orifice therein, said orifice being sized at least large enough to receive the end of the fence post therein.

12. A post driver according to claim 1, wherein said containment structure comprises:

(b1) a tubular collar, said tubular collar having a first end and a second end, said first end of said collar being affixed to said mounting plate, (b2) a stationary rotation plate, said stationary rotation plate being affixed to said tubular collar proximate to said second end, said stationary rotation plate having a plurality of stop positions placed therein, (b3) a guide cylinder, said guide cylinder having a upper terminus and a lower terminus, said upper terminus being sized to fit within said second end of said tubular collar and being rotatably secured therein, said guide cylinder having a central cavity at least large enough to accommodate an end of the fence post therein, said lower terminus having an orifice therein, said orifice being sized at least large enough to receive the end of the fence post therein, and, (b4) a movable rotation plate proximate to said stationary rotation plate, said movable rotation plate being affixed to said guide cylinder proximate to said upper terminus and rotatable therewith, wherein said movable plate has a plurality of longitudinally movable pins mounted thereon and projecting therethrough, said pins being retractable to allow rotation of said movable rotation plate and said guide cylinder, and insertable into a matching plurality of said stop positions in said stationary rotation plate to fix said movable rotation plate in place.

13. A post driver suitable for attachment to a lift arm of a mechanized device, wherein said lift arm may be at least raised and lowered by said mechanized device under operator control, thereby driving a fence post into the ground when the fence post is within said post driver during its lowering, said post driver comprising:

(a) a mounting plate, said mounting plate at least for attachment to an under side of the lift arm;

(b) a rigid linear containment structure having a central cavity at least large enough to accommodate an end of the fence post therein, said containment structure having an upper terminus and a lower terminus, said upper terminus of said containment structure being secured to said mounting plate and said lower terminus having an orifice therein, said orifice (i) providing access to said central cavity of said containment structure, and, (ii) being sized at least large enough to receive the end of the fence post into said central cavity;

(c) a roller latch assembly in mechanical communication with said mounting plate, wherein said roller latch assembly is mounted directly on an exterior of said containment structure, said roller latch at least for providing a biasing force urging said roller against the fence post when the fence post is positioned within said central cavity, said roller latch comprising:

(c1) a first and a second swing arm, each of said swing arms being rotatably mounted to an opposite side of said containment structure, (c2) a tension plate connecting said first and second swing arms, said tension plate having at least one aperture therethrough, (c3) a biasing post having a first end and a second end, wherein said first end of said biasing post is affixed to said containment structure, and wherein said second end of said biasing post is positionable to pass through said aperture in said tension plate, (c4) a roller latch supported by said first and second swing arms, said roller latch being positionable to contact the fence post when it is present within said containment structure, and, (c5) a biasing element situated proximate to said second end of said biasing post and in mechanical communication therewith, said biasing element providing a biasing force against said tension plate and said roller latch and toward said containment structure, said roller latch being forced against the fence post when it is present within said containment structure, wherein (i) said biasing force is opposed by an inner wall of said containment structure, and (ii) said biasing force is sufficient to hold the fence post within said containment structure against a force of gravity but insufficient to hold the fence post within the containment structure after the post has been at least partially inserted within the earth.

14. A post driver according to claim 13, wherein said biasing element is a coil spring.

15. A post driver according to claim 13, wherein said roller latch is circular in cross section.

16. A post driver suitable for attachment to a lift arm of a mechanized device, wherein said lift arm may be at least raised and lowered by said mechanized device under operator control, thereby driving a fence post into the ground when the fence post is within said post driver during its lowering, said post driver comprising:

(a) a mounting plate, said mounting plate at least for attachment to an under side of the lift arm;

(b) a rigid linear containment structure having a central cavity at least large enough to accommodate an end of the fence post therein, said containment structure having an upper terminus and a lower terminus, said upper terminus of said containment structure being secured to said mounting plate and said lower terminus having an orifice therein, said orifice (i) providing access to said central cavity of said containment structure, and, (ii) being sized at least large enough to receive the end of the fence post into said central cavity;

(c) a roller latch assembly in mechanical communication with said mounting plate, said roller latch comprising a roller and a tensioning spring, said roller being positionable to be urged against the fence post by said tensioning spring when the fence post is positioned within said central cavity, said tensioning spring at least for providing a biasing force urging said roller against the fence post when the fence post is positioned within said central cavity, wherein (i) said biasing force is opposed by an inner wall of said containment structure, and (ii) said biasing force is sufficient to hold the fence post above the ground within said containment structure against a vertical force of gravity but insufficient to hold the fence post within the containment structure when the containment structure is lifted after the fence post has been at least partially inserted into the ground.

17. The post driver according to claim 16, wherein said tensioning spring is a coil spring.

* * * * *